US008534092B2

(12) United States Patent
Lee et al.

(10) Patent No.: US 8,534,092 B2
(45) Date of Patent: Sep. 17, 2013

(54) INDOOR UNIT OF AIR CONDITIONER

(75) Inventors: Juhyoung Lee, Seoul (KR); Deok Huh, Seoul (KR); Seongwon Bae, Seoul (KR); Kiwon Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 338 days.

(21) Appl. No.: 12/904,527

(22) Filed: Oct. 14, 2010

(65) Prior Publication Data

US 2011/0277495 A1 Nov. 17, 2011

(30) Foreign Application Priority Data

May 13, 2010 (KR) ..... 10-2010-0044990

(51) Int. Cl.
*F25D 17/06* (2006.01)

(52) U.S. Cl.
USPC ..... 62/428; 62/449

(58) Field of Classification Search
USPC ..... 62/428, 263, 449, 419, 414, 408, 62/187; 165/75, 122
See application file for complete search history.

(56) References Cited

U.S. PATENT DOCUMENTS

| | | | | |
|---|---|---|---|---|
| 4,020,753 | A | 5/1977 | Efstratis | |
| 5,600,963 | A * | 2/1997 | Koo et al. | 62/262 |
| 5,769,707 | A * | 6/1998 | Jang et al. | 454/233 |
| 7,040,101 | B2 * | 5/2006 | Takeda et al. | 62/78 |
| 7,275,388 | B2 * | 10/2007 | Joo et al. | 62/408 |
| 7,350,371 | B2 * | 4/2008 | Lee et al. | 62/317 |
| 7,530,189 | B2 * | 5/2009 | Kim et al. | 40/725 |
| 7,607,251 | B2 * | 10/2009 | Kim et al. | 40/725 |
| 7,670,414 | B2 * | 3/2010 | Cha et al. | 96/398 |
| 7,849,706 | B2 * | 12/2010 | Yasutomi et al. | 62/298 |
| 7,878,017 | B2 * | 2/2011 | Yasutomi | 62/263 |
| 8,074,462 | B2 * | 12/2011 | Yasutomi et al. | 62/263 |
| 8,171,748 | B2 * | 5/2012 | Ooishi et al. | 62/263 |

FOREIGN PATENT DOCUMENTS

| | | |
|---|---|---|
| CN | 1158401 | 9/1997 |
| EP | 1 950 502 | 7/2008 |
| KR | 1997-0047395 | 7/1997 |
| KR | 10-2005-0014294 | 2/2005 |
| WO | WO 02/103251 | 12/2002 |
| WO | WO 2009/057869 | 5/2009 |

OTHER PUBLICATIONS

European Search Report issued in EP Application No. 10188203 dated Oct. 4, 2011.
Chinese Office Action issued in CN Appln. No. 201010543797.1 dated Jun. 4, 2013 (full English translation).

* cited by examiner

*Primary Examiner* — Mohammad M Ali
(74) *Attorney, Agent, or Firm* — KED & Associates LLP

(57) ABSTRACT

An indoor unit of an air conditioner is provided. A width of the indoor unit of the air conditioner may be varied based on whether or not the indoor unit of the air conditioner is operated.

25 Claims, 9 Drawing Sheets

INDOOR UNIT OF AIR CONDITIONER

CROSS-REFERENCE TO RELATED APPLICATION(S)

This application claims the benefit of Korean Patent Application No. 10-2010-0044990, filed in Korea on May 13, 2010, which is hereby incorporated by reference as if fully set forth herein.

BACKGROUND

1. Field

This relates to an indoor unit of an air conditioner.

2. Background

In general, an air conditioner cools or heats a designated space, such as, for example, an indoor room, by performing heat-exchange between air from the space and low-temperature or high-temperature refrigerant as appropriate, and then discharging the heat-exchanged air into the space. Generally, an air conditioner includes a compressor, an outdoor heat exchanger, an expansion valve, and an indoor heat exchanger. Besides an air cooling and heating function, air conditioners may include various additional functions, such as, for example, air purification and filtering, dehumidification, and other such functions.

Types of air conditioners may include a split type air conditioner in which an outdoor unit and an indoor unit are separately installed, and an integrated type air conditioner in which an outdoor unit and an indoor unit are integrally provided. The split type air conditioner may minimize introduction of noise generated by a compressor in the outdoor unit into the designated space and may reduce a volume of the indoor unit installed in the space.

The indoor unit of the split type air conditioner may include a heat exchanger that performs a heat exchange between air and refrigerant supplied from the outdoor unit, and a fan that takes in and discharges the air. Therefore, the indoor unit includes a flow path to which the air is introduced into the indoor unit and discharged from the indoor unit, and a width of the indoor unit may be set to provide an appropriate flow path. Even though the air conditioner is mainly used when the weather requires the space to be cooled or heated, the indoor unit remains in the space. As such, the appearance of the indoor unit may designed to blend with or complement other indoor articles in the space. If the indoor unit is mounted on an interior wall, the indoor unit has a certain width and extends outward a certain distance into the space.

If the indoor unit protrudes excessively far into the room, even when the indoor unit is not operated, the indoor unit may detract from the utility and appearance of the space.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to embodiments, examples of which are illustrated in the accompanying drawings. It is to be understood by those of ordinary skill in this technological field that other embodiments may be utilized, and structural, electrical, as well as procedural changes may be made without departing from the scope as broadly described herein. Wherever possible, the same reference numbers will be used throughout the drawings to refer to the same or like parts.

Figure 1:
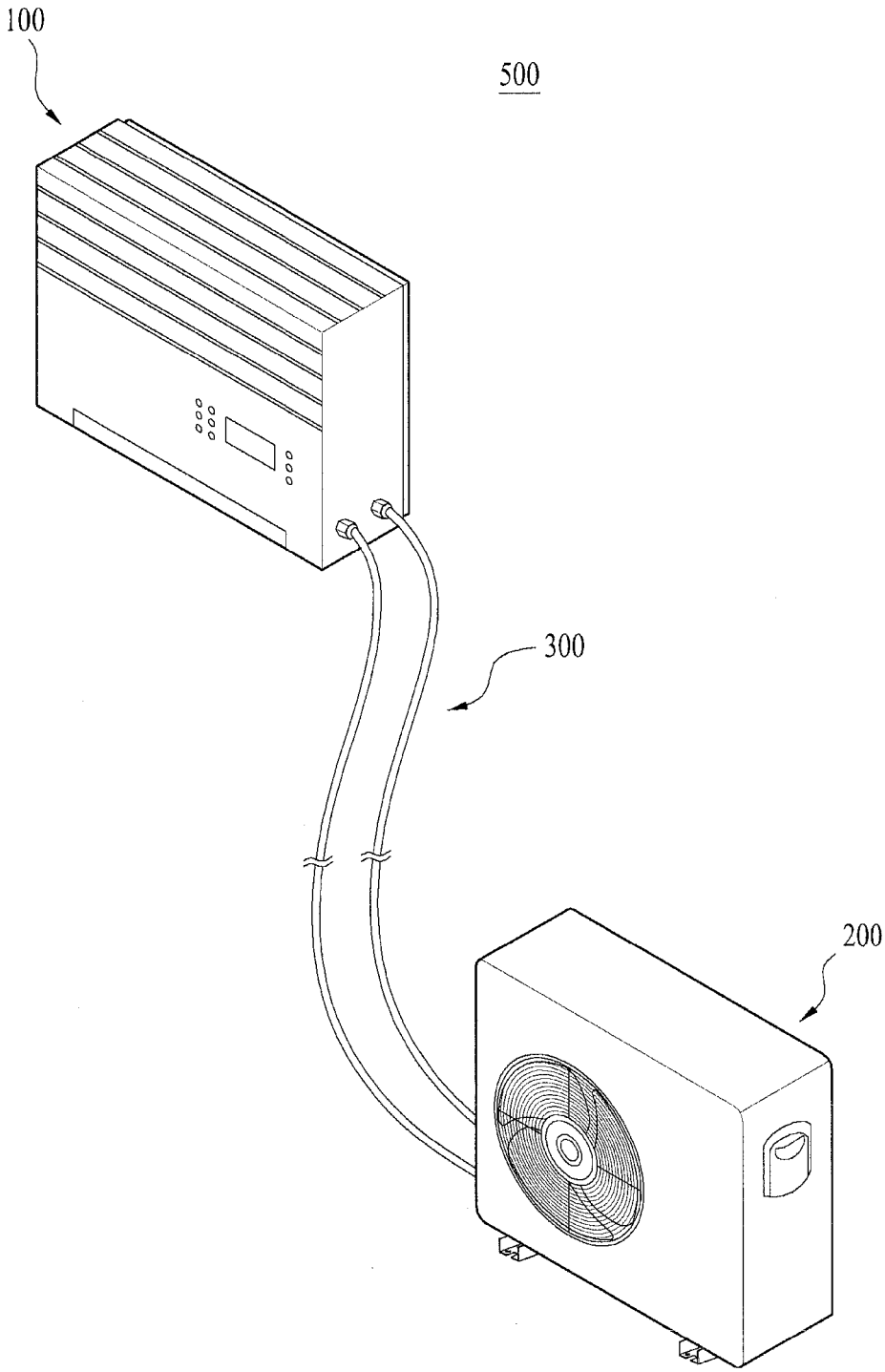
FIG. 1 illustrates a non-operating state of an air conditioner in accordance with an embodiment as broadly described herein.

The air conditioner 500 shown in FIG. 1 may include an indoor unit 100 to condition air in a designated space, such as, for example, an indoor space, or room, and an outdoor unit 200 connected to the indoor unit 100 by refrigerant pipes 300. As described above, the air conditioner 500 is capable of performing a process of cooling and heating a space, a process of humidifying or dehumidifying air, a process of purifying air, and other processes as appropriate.

In the embodiment as shown in FIG. 1, the indoor unit 100 and the outdoor unit 200 are separated, and the indoor unit 100 may be mounted on a wall or other room structure as appropriate. An indoor heat exchanger and an outdoor heat exchanger may be respectively provided in the indoor unit 100 and the outdoor unit 200. In order to cool the room space, room air is cooled by evaporating a refrigerant in the indoor heat exchanger, and in order to heat the room space, the air is heated by evaporating the refrigerant in the outdoor heat exchanger and condensing the refrigerant in the indoor heat exchanger.

In order to design the air conditioner so that it blends well with the room environment, a width of the indoor unit 100 may be reduced. However, an indoor heat exchanger and a fan are provided in the indoor unit 100, and a flow path extends therethrough, thus requiring a sufficient amount of interior space. Therefore, in certain circumstances, it may appear that the performance of the indoor unit 100 may be in inverse proportion to the width of the indoor unit 100. When the air conditioner is not in use, it is preferable that the width of the indoor unit 100 be minimized so as to optimize the use of space in the room and be more visually appealing.

Figure 2:
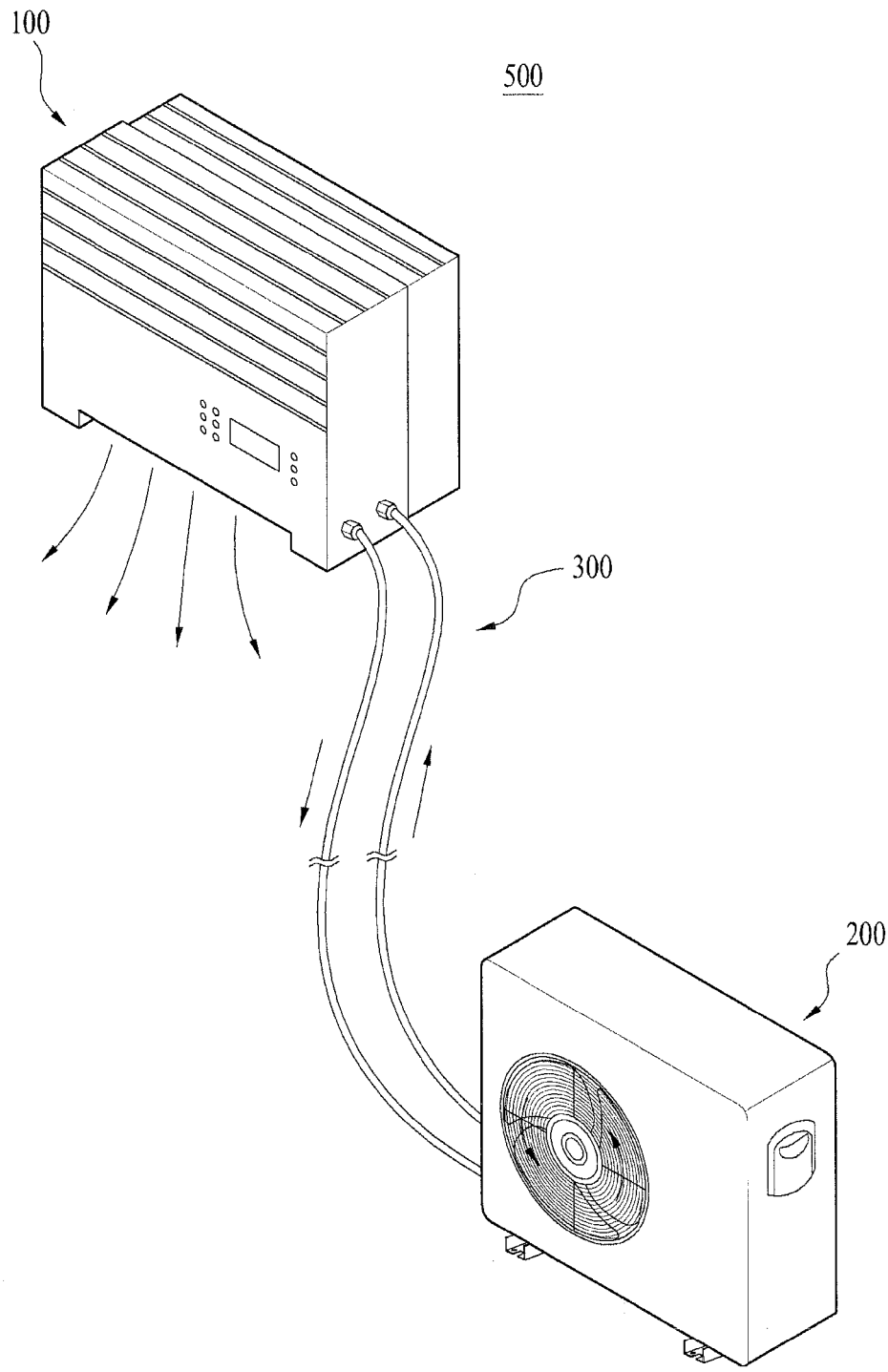
FIG. 2 illustrates a operating state of an air conditioner in accordance with an embodiment as broadly described herein.

FIG. 1 illustrates a non-operating state of the air conditioner 500 in which a width of the indoor unit 100 may be decreased when the indoor unit 100 is not operated. The width of the indoor unit 100 may be increased, as shown in FIG. 2, when the indoor unit 100 is operated to provide an appropriate flow path, thereby maximizing utility of the room space and improving appearance when the air conditioner 500 is not in use.

Hereinafter, detailed methods of varying the width of the indoor unit 100 according to whether or not the air conditioner 500 is operated will be described with reference to FIGS. 3A-7B.

Figure 3A:
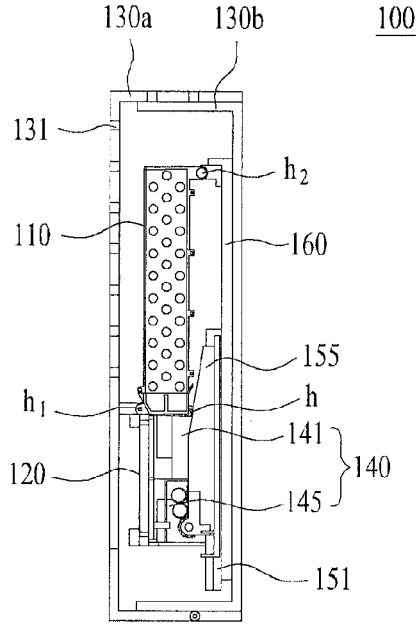
FIGS. 3A and 3B are side sectional views of the indoor unit of the air conditioner shown in FIGS. 1 and 2.
Figure 3B:
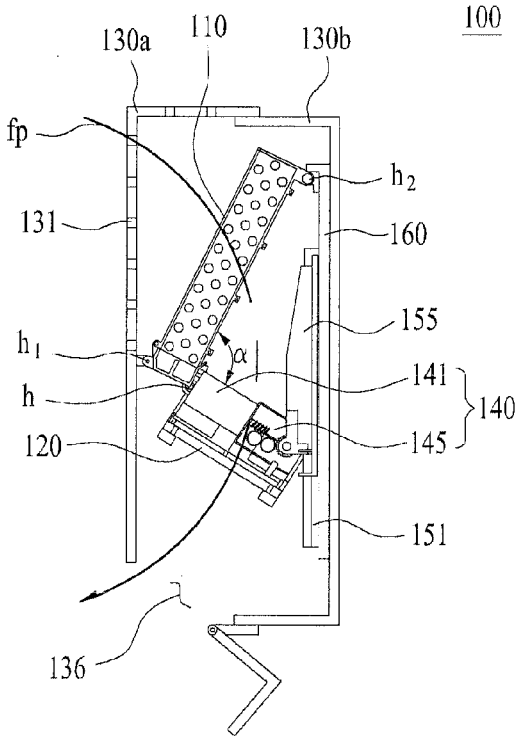

The indoor unit 100 shown in FIGS. 3A-3B may include a heat exchanger 110, a fan 120 that draws in air and then directs the air toward the heat exchanger 110 and discharges the heat-exchanged air into a room space, and a driving device 140 that adjusts relative positions of the heat exchanger 110 and the fan 120 based on whether or not the indoor unit 100 is operated.

In the embodiment shown in FIGS. 3A-3B, both the distance between the heat exchanger 110 and the fan 120, and an interior angle α between the heat exchanger 110 and the fan 120 may be adjusted based on whether or not the indoor unit 100 is operated. One end of the heat exchanger 110 and a corresponding end of the fan 120 may be rotatably connected by a hinge h, and the heat exchanger 110 and the fan 120 may be rotated about the hinge h such that the angle α between the heat exchanger 110 and the fan 120 may be adjusted while the indoor unit 100 is operated. The angle α between the heat exchanger 110 and the fan 120 during operation of the indoor unit 100, as shown in FIG. 3B, may be less than the angle between the heat exchanger 110 and the fan 120 during non-operation of the indoor unit 100, as shown in FIG. 3A. Operating the indoor unit 100 may be defined broadly as supplying electricity to the indoor unit 100, or narrowly as turning on the fan 120.

For example, as shown in FIG. 3A, in the non-operating state of the indoor unit 100, the heat exchanger 110 and the fan 120 are disposed substantially in a line and a width of the indoor unit 100 may be minimized. When the indoor unit 100 is not operated, the angle between the heat exchanger 110 and the fan 120 may be about 180°. The hinge h that rotatably connects the heat exchanger 110 and the fan 120 allows the connecting angle between the heat exchanger 110 and the fan 120 to be adjusted based on whether or not the indoor unit 100 is operated. In certain embodiments, the fan 120 may be one or more axial fans having a small blade height to facilitate this movement and minimize the width of the fan 120.

An upper end of the heat exchanger 110 may be rotatably connected to a base frame 160 of the indoor unit 100 by a hinge h2, and a lower end of the heat exchanger 110 may be rotatably connected to an upper end of the fan 120 by the hinge h, and to a front housing 130*a* by a hinge h1. A lower end of the fan 120 may be connected to a slider 155 that is slidably coupled to a slide guide 151 provided on the base frame 160. Vertical movement of the slider 155 is guided by the slide guide 151 such that when the fan 120 connected to the slider 155 is raised or lowered along the slide guide 151, the angle between the fan 120 and the heat exchanger 110 is changed.

The indoor unit 100 includes a housing (front and rear housings 130*a* and 130*b*) provided with an inlet 131 through which air is introduced into the housing and an outlet 136 through which air is discharged from the housing. A flow path within the housing, from the inlet 131 to the outlet 136 via the heat exchanger 110 and the fan 120, may be adjusted based on whether or not the indoor unit 100 is operated.

As shown in FIG. 3B, when the indoor unit 100 is operated, the flow path is formed within the housing of the indoor unit 100. That is, the angle between the heat exchanger 110 and the fan 120 is changed to an angle less than 180° so as to form the flow path and allow the heat-exchanged air to be re-supplied to the room space through the fan 120. When the heat exchanger 110 and the fan 120 are arranged in a line, as shown in FIG. 3A, the inner space of the indoor unit 100 is not sufficient to form the flow path inside the housing.

As shown in FIG. 3B, the flow path from the inlet 131 to the outlet 136 via the heat exchanger 110 and the fan 120 may be selectively generated as necessary. The flow path may be minimized, or substantially eliminated, during non-operation of the indoor unit 100, as shown in FIG. 3A, and is generated, or maximized, during operation of the indoor unit 100, as shown in FIG. 3B. The selective generation and removal of the flow path is controlled based on whether or not there is enough inner space in the housing. In the embodiment shown in FIG. 3B, the flow path starts at the inlet 131 and passes through the heat exchanger 110 and the fan 120. The flow path may include a bending section. The bending section may be changed based on relative positions of the inlet 131 and the outlet 136. Further, when the flow path is eliminated, as shown in FIG. 3A, one or both of the inlet 131 and the outlet 136 may be blocked.

A driving force to raise or lower the lower end of the fan 120 together with the slider 155 along the slide guide 151 may be generated by a driving device 140 including, for example, a motor 141 and a gear assembly 145. The gear assembly 145 may be driven by the motor 141 and may include, for example, a worm gear or a rack-pinion arrangement. Other arrangements may also be appropriate. The gear assembly 145 may use the driving force of the motor 141 to raise or lower the slider 155 as the motor 141 is rotated. The driving device 140 may be fixed to the fan 120 so that the driving device 140 may be rotated together with the fan 120 relative to the heat exchanger 110.

When operation of the indoor unit 100 is initiated, for example, when operation of the fan 120 of the indoor unit 100 is initiated, the motor 141 of the driving device 140 is rotated and the driving force of the motor 141 raises the slider 155, thereby decreasing the angle between the heat exchanger 110 and the fan 120, expanding the housing, and forming the flow path, as shown in FIG. 3B. If the driving device 140 includes a worm gear, the slider 155 may be prevented from falling due to the weight of the slider 155 itself even if power applied to the motor 141 is released.

The housing of the indoor unit 100 may include a front housing 130*a* and a rear housing 130*b*, and the front housing 130*a* and the rear housing 130*b* may partially overlap each other. In other words, one of the front housing 130*a* or the rear housing 130*b* may be partially inserted into the other when the indoor unit 100 does not operate, as shown in FIG. 3A.

When the indoor unit 100 is not operated, as shown in FIG. 3A, the angle between the heat exchanger 110 and the fan 120 is maintained at about 180°, but when the indoor unit 100 is operated, as shown in FIG. 3B, the driving device 140 is driven such that the angle α between the heat exchanger 110 and the fan 120 is decreased (changed) to an angle less than 180°. If the width of the indoor unit 100 is increased to accommodate this change, as shown in FIG. 3B, the front housing 130*a* slides away from the rear housing 130*b* so as to increase the width of the indoor unit 100.

In the embodiment shown in FIGS. 3A and 3B, a plurality of inlets 131 and a plurality of outlets 136 are provided on the front housing 130*a*. Further, in the embodiment shown in FIGS. 3A and 3B, the front housing 130*a* is connected to the lower end of the heat exchanger 110 by the hinge h1, and thus the sliding of the front and rear housings 130*a* and 130*b* may correspond to vertical movement of the slider 155 and corresponding displacement of the heat exchanger 110.

Since the heat exchanger 110 and the fan 120 are connected by the hinge h, the distance between the heat exchanger 110 and the fan 120, the relative positions of the heat exchanger 110 and the fan 120, or the angle between the heat exchanger 110 and the fan 120, may vary and the flow path in the housing may be generated or eliminated within the inner space of the indoor unit 100, based on whether or not the indoor unit 100 of the air conditioner is operated. Therefore, the above configuration allows the width of the indoor unit 100 to vary.

Although the embodiment shown in FIGS. 3A and 3B includes the driving device 140 to change the angle between the heat exchanger 110 and the fan 120, the driving device 140 may be mounted at other locations.

In the embodiments of the indoor unit 100 shown in FIGS. 4A-4D since the heat exchanger 110 and the fan 120 are connected by the hinge h, the relative positions of the heat exchanger 110 and the fan 120 may be changed and the flow path through the housing may be generated or eliminated based on whether or not the indoor unit 100 is operated. However, in the embodiment shown in FIG. 4A, the driving device 140 to change the angle between the heat exchanger 110 and the fan 120 is provided on the heat exchanger 110. In the embodiment shown in FIG. 4B, the driving device 140 is fixed to the slider 155. In the embodiment shown in FIG. 4C, opposite ends of the driving device 140 are respectively mounted on the fan 120 and the base frame 160. In the embodiment shown in FIG. 4D, the driving device 140 directly connects the heat exchanger 110 and the fan 120.

Figure 4A:
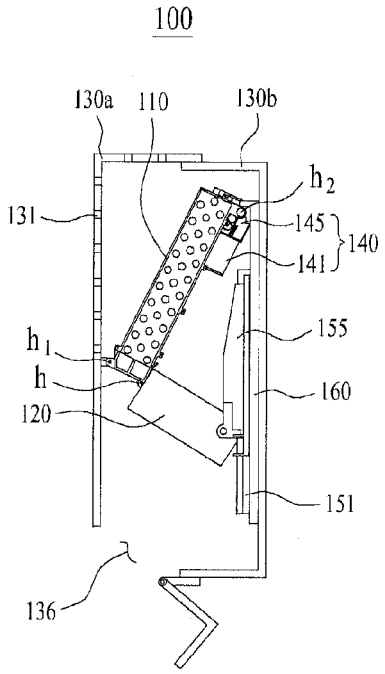
FIGS. 4A-4D are side sectional views of an indoor unit of the air conditioner in accordance with embodiments as broadly described herein.
Figure 4B:
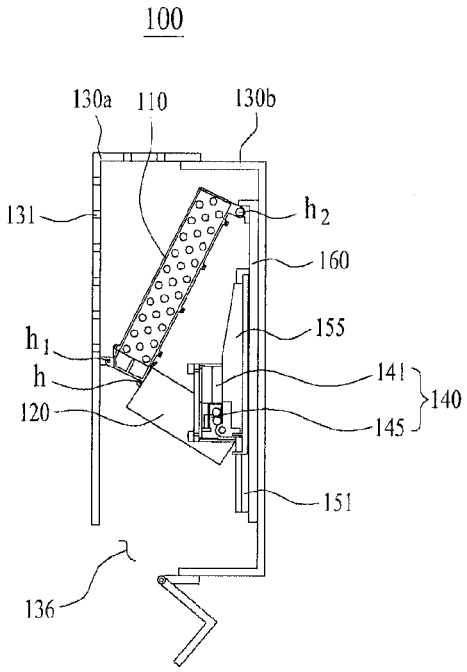
Figure 4C:
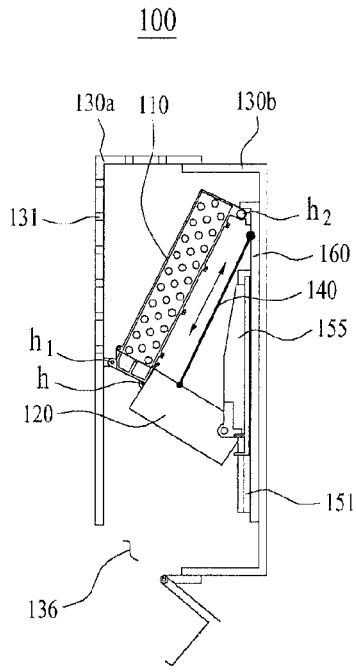
Figure 4D:
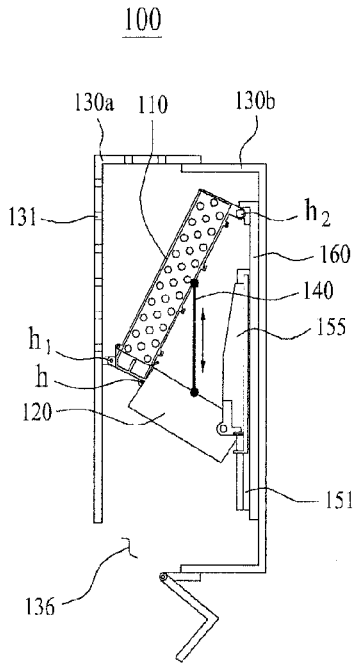

The embodiments of FIGS. 4A and 4B each include a driving device 140 including a motor 141 and a gear assembly 145. The embodiments of FIGS. 4C and 4D each include a linear driving device 140. Such a linear driving device 140 may include, for example, a rigid link which may be powered/rotated by a motor, a telescoping link, or other linear driving device as appropriate.

The respective embodiments of FIGS. 4A-4D differ from each other in that the mounting positions of the driving devices 140 or components of the driving devices 140 may be varied, but are similar in that the angle between the heat exchanger 110 and the fan 120 in each is changed by the driving device 140. As far as the indoor unit 100 has a structure in which the relative positions between the heat exchanger 110 and the fan 120 are changeable, structures of the indoor unit 100 as embodied and broadly described herein are not limited to the embodiments shown in FIGS. 3A-3B and 4A-4D.

Figure 5A:
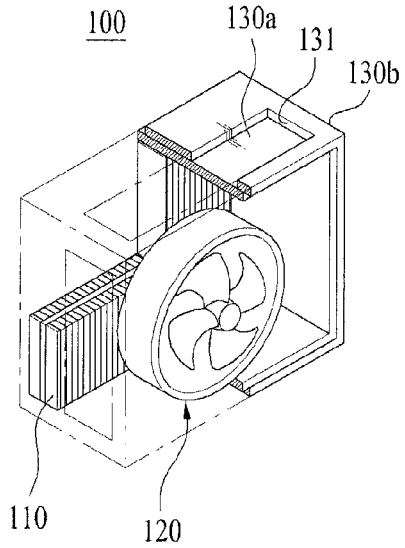
FIGS. 5A-5D are perspective and side sectional views of an indoor unit of the air conditioner in accordance with embodiments as broadly described herein.
Figure 5B:
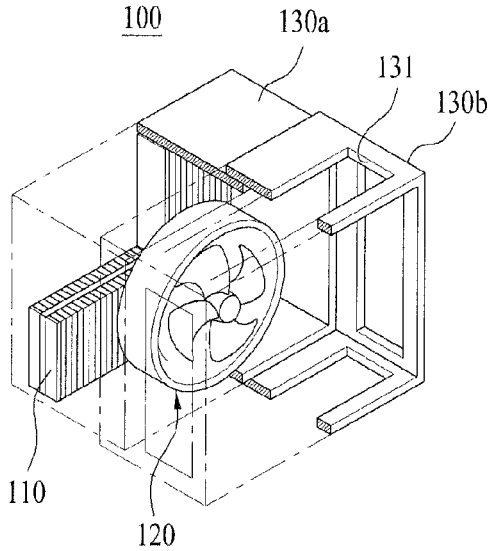
Figure 5C:
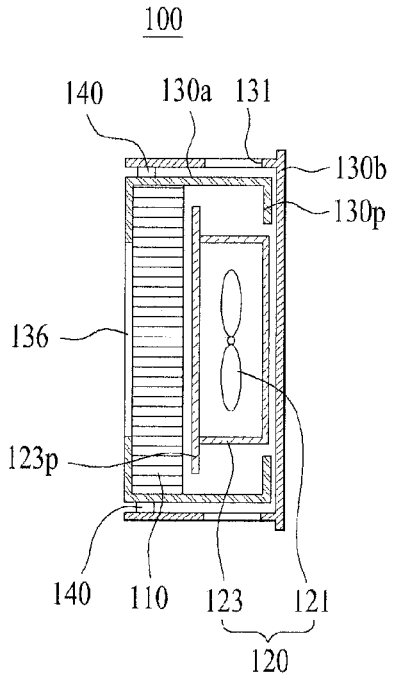
Figure 5D:
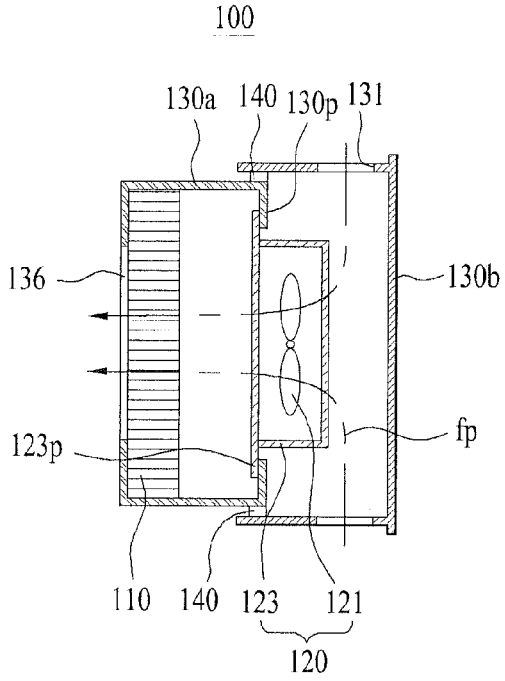

FIGS. 5A-5D illustrate another embodiment of the indoor unit 100 of the air conditioner as broadly described herein. FIG. 5A is a perspective view of the inside of the indoor unit 100 in a non-operating state, and FIG. 5B is a perspective view of an operating state. FIG. 5C is a longitudinal-sectional view of the indoor unit 100 shown in FIG. 5A, and FIG. 5D is a longitudinal-sectional view of the indoor unit 100 shown in FIG. 5B.

In the embodiment shown in FIGS. 5A-5D, a distance between the heat exchanger 110 and the fan 120 of the indoor unit 100 is variable. That is, at least one of the heat exchanger 110 or the fan 120 may be displaced in the horizontal direction, and the distance between the heat exchanger 110 and the fan 120 may be increased by moving the heat exchanger 110 and the fan 120 apart. This change in distance between the heat exchanger 110 and the fan 120 causes a change in the width of the indoor unit 100. Therefore, in the embodiment shown in FIGS. 5A-5D, the width of the indoor unit 100 may be changed based on a change in the distance between the heat exchanger 110 and the fan 120. When the indoor unit 100 is operated, the width of the indoor unit 100 is increased, and when the indoor unit 100 is not operated, the width of the indoor unit 100 is decreased. The decrease in the width of the housing during non-operation of the fan 120 may be caused by partially overlapping the front housing 130*a* over the rear housing 130*b*, or by partially inserting one of the front housing 130*a* or the rear housing 130*b* into the other.

In the embodiment shown in FIGS. 5A-5D, the front and rear housings 130*a* and 130*b* are aligned in a horizontal direction. In certain embodiments, the front and rear housings 130*a* and 130*b* may be aligned in the vertical direction, or disposed in a stacking position when the width of the indoor unit 100 is at the minimum width.

In more detail, the housing of the indoor unit 100 of the air conditioner shown in FIGS. 5A-5D includes a front housing 130*a* and a rear housing 130*b*, and the width of the indoor unit 100 may be varied by overlapping the front housing 130*a* and the rear housing 130*b* such that the front and rear housings 130*a* and 130*b* are slideable relative to each other.

At least one inlet 131 may be provided on a side surface of the rear housing 130*b* such that air is introduced in to the housing through the inlet 131 when the front and rear housings 130*a* and 130*b* are in an "open" position as shown in FIG. 5D, and the inlet 131 is blocked when the front housing 130*a* and the rear housing 130*b* overlap each other as shown in FIG. 5C. That is, when the indoor unit 100 is not operated, the front housing 130*a* is located at the inside of the rear housing 130*b* and the inlet 131 formed on the rear housing 130*b* is blocked by a corresponding portion of the front housing 130*a*, thereby preventing introduction of foreign substances into the housing through the inlet 131 when the indoor unit 100 is not operated. Therefore, the inlet 131 may be opened to the outside only during operation of the indoor unit 100. This type of flow path shielding structure is not limited to the inlet 131, but at least one of the inlet 131 or the outlet 136, or both, may be configured so as to be opened to the outside only during operation of the indoor unit 100, and the flow path may be generated or eliminated by the opening or blockage of one of the inlet 131 or the outlet 136, or both. As shown in FIGS. 5C and 5D, outlet 136 through which air is discharged from the heat exchanger 110 may be provided on the front surface of the front housing 130*a*.

The indoor unit 100 may also include a driving device 140 to guide the movement of the front housing 130*a* or the rear housing 130*b*. The driving device 140 shown in FIGS. 5A-5D may include, for example, a motor and a gear assembly. The gear assembly may include, for example, a rack and a pinion to convert the rotating force of the motor into a horizontal reciprocating motion. The driving device 140 may be mounted on the rear housing 130*b* fixed to a wall of the room space, but the mounting position of the driving device 140 is not limited thereto.

The heat exchanger 110 and the fan 120 of the indoor unit 100 of the air conditioner in accordance with embodiments as broadly described herein may be in close contact with each other when the width of the indoor unit 100 is at its minimum, and may be relatively distantly separated from each other when the width of the indoor unit 100 is at its maximum. In certain embodiments, the fan 120 may be coupled to the rear housing 130*b*, but may be displaced by a designated distance within the rear housing 130*b* in order to sufficiently obtain a smoothly curved flow path from the inlet 131 to the outlet 136.

A separate driving device to change the position of the fan 120 may be provided. However, the fan 120 may be configured such that a fan housing 123 of the fan 120 moves together with the front housing 130*a* within a predetermined displacement range. For example, protrusions 130*p* and 123*p* may be respectively formed on an inner end of the front housing 130*a* and a front end of the fan housing 123. As the front housing 130*a* moves, the protrusions 130*p* and 123*p* engage, allowing the fan 120 to be drawn away from the rear housing 130*b* by the front housing 130*a* on which the heat exchanger 110 is mounted. Therefore, when operation of the indoor unit 100 is initiated and the front housing 130*a* is slidably displaced in a direction of increasing the width of the indoor unit 100, the protrusion 130*p* of the front housing 130*a* engages the protrusion 123*p* of the fan housing 123, thereby allowing the fan 120 to be displaced in the moving direction of the heat exchanger 110. Thus, when the front housing 130*a* of the indoor unit 100 is driven, the width of the indoor unit 100 is increased as the distance between the heat exchanger 110 and the fan 120 is increased, and a flow path is created.

Figure 6A:
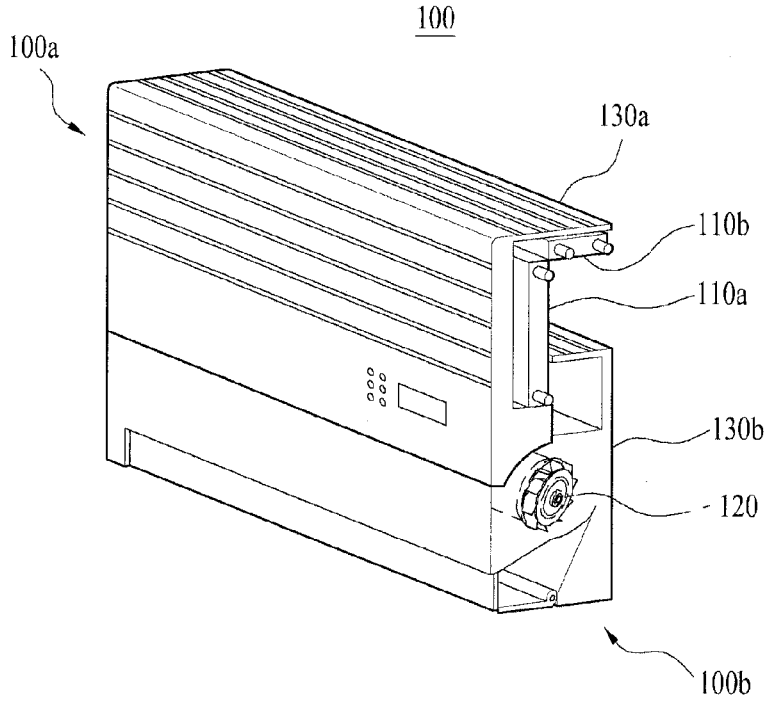
FIGS. 6A-6B are perspective views of an indoor unit of the air conditioner in accordance with embodiments as broadly described herein.
Figure 6B:
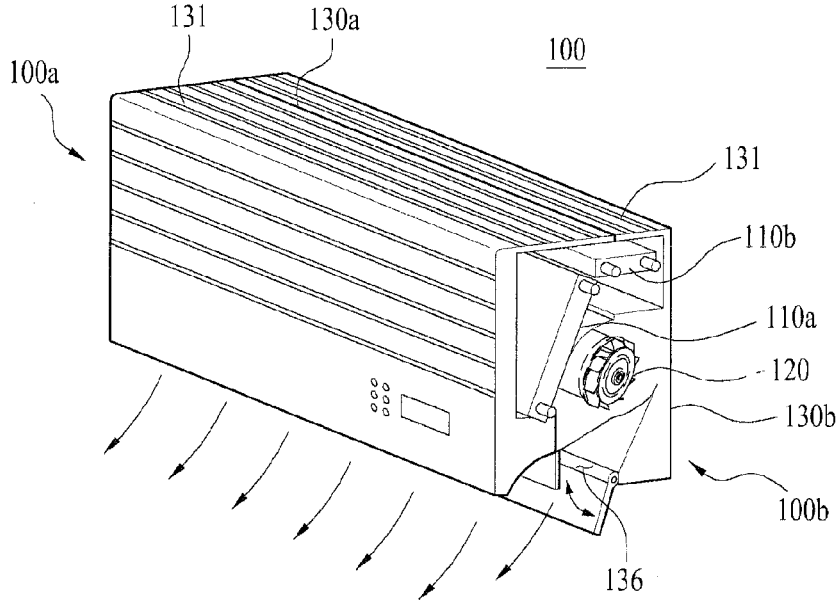

FIG. 6A is a perspective view of the indoor unit 100 in a non-operating state of the air conditioner, and FIG. 6B is a perspective view of the indoor unit 100 in an operating state of the air conditioner, in accordance with another embodiment as broadly described herein.

In the embodiment shown in FIGS. 6A and 6B, front and rear housings 130*a* and 130*b* are aligned in the vertical direction, as shown in FIG. 6A, when in a non-operating state. The vertically aligned state is released in a direction of increasing the width of the housing (and decreasing a height) when the indoor unit 100 is operated, as shown in FIG. 6B, and the housings 130*a* and 130*b* are horizontally arranged. Further, the heat exchanger 110 may be provided in the front/upper housing 130*a* and the fan 120 may be provided in the rear/lower housing 130*b*.

In the embodiment shown in FIGS. 6A and 6B, the indoor unit 100 may include a first main body 100*a* including the heat exchanger 110 and a second main body 100*b* including the fan 120. The first main body 100*a* or the second main body 100*b* may be displaced such that the first main body 100*a* and the second main body 100*b* are either horizontally disposed or vertically aligned, based on whether or not the indoor unit 100 is operated. When the first main body 100*a* or the second main body 100*b* is displaced, the relative positions of the heat exchanger 110 and the fan 120 may be changed. As shown in FIGS. 6A-6B, the first main body 100*a* and the second main body 100*b* are aligned in the vertical direction when the indoor unit 100 is not operated, as shown in FIG. 6A, and are disposed in the horizontal direction when the indoor unit 100 is operated as shown in FIG. 6B.

At least one inlet 131 may be provided on upper and front surfaces of the first main body 100*a* and an upper surface of the second main body 100*b*. When the first main body 100*a* and the second main body 100*b* are disposed in the horizontal direction and thus a flow path is formed in the indoor unit 100, as shown in FIG. 6B, the air introduced through the inlet 131 may be discharged into a room space through an outlet 136 provided on the lower surfaces of the first main body 100*a* and the second main body 100*b*.

The heat exchanger 110 may be divided into at least two heat exchangers 110*a* and 110*b*, and the respective heat exchangers 110*a* and 110*b* may be hinge-coupled such that a angle between the heat exchangers 110*a* and 110*b* is changeable. In particular, the angle of the heat exchangers 110*a* and 110*b* may be changed such that a width of the heat exchanger 110 in the horizontal direction is increased when a width of the indoor unit 100 in the horizontal direction is increased.

In the embodiment shown in FIGS. 6A and 6B, the heat exchanger 110 provided in the front housing 130*a* is divided into at least two heat exchangers 110*a* and 110*b*, and the respective heat exchangers 110*a* and 110*b* are hinge-coupled such that the angle between them is changeable by the displacement of the first main body 100*a* or the second main body 100*b*.

When the indoor unit 100 is not operated, as shown in FIG. 6A, the heat exchanger 110, divided into the first heat exchanger 110*a* and the second heat exchanger 110*b*, is displaced so as to be in close contact with the inner surface of the front housing 130*a* of the first main body 100*a*. When the indoor unit 100 is operated, as shown in FIG. 6B, the angle between the first and second heat exchangers 110*a* and 110*b* is increased so as to increase an area in which heat exchange may be carried out.

Figure 7A:
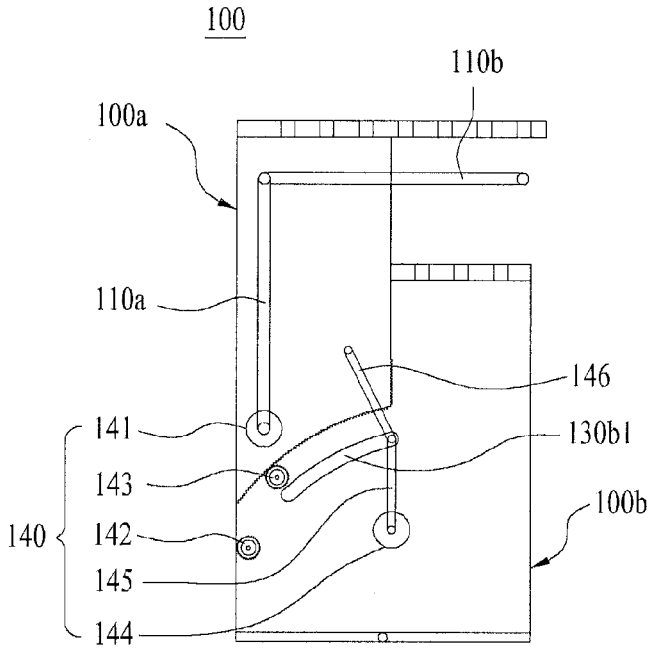
FIGS. 7A and 7B illustrate operating states of the indoor unit shown in FIGS. 6A and 6B.
Figure 7B:
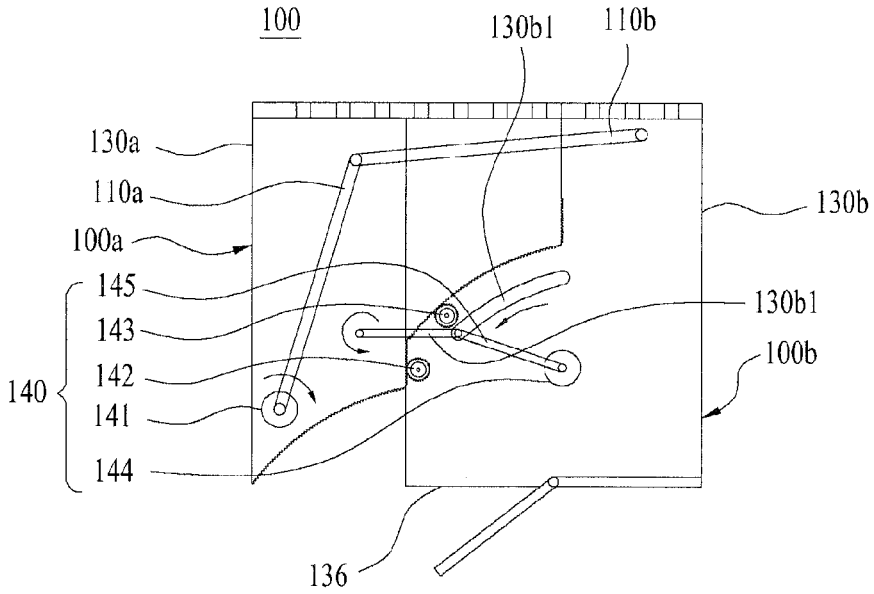

FIGS. 7A and 7B illustrate a driving device 140 of the indoor unit 100 shown in FIGS. 6A and 6B. As described above, the decrease in the width of the indoor unit 100 during non-operation of the fan 120 is caused by partially overlapping or vertically aligning the front and rear housings 130*a* and 130*b*.

The indoor unit 100 may include at least one link 146 and driving gear 143 to drive the front and rear housing 130*a* and 130*b* such that relative positions of the two housings 130*a* and 130*b* may be changed. A lower end of the link 146 slides in a guide groove formed in one of the two housings 130*a* and 130*b*, and an upper end of the link 146 is rotatable around the lower end of the link 146. The link 146 allows the first main body 100*a* to be displaced such that the relative position of the first main body 100*a* is changeable along the upper surface of the second main body 100*b*.

In the embodiment of FIGS. 6A and 6B, the front and rear housings 130*a* and 130*b* are aligned in the vertical direction in a non-operating state, and the vertically aligned position of the housings 130*a* and 130*b* is released in a direction of increasing the width of the indoor unit 100 during operation of the indoor unit 100. Further, as described above, the heat exchanger 110 is provided in the front housing 130*a* and the fan 120 is provided in the rear housing 130*b*.

An operating method of the indoor unit 100 shown in FIGS. 7A and 7B will be described in more detail.

The first main body 100*a* and the second main body 100*b* are connected by the link 146 so as to allow the relative positions between the first and second main bodies 100*a* and 100*b* to vary. The link 146 is rotatably connected to a rotary arm 145 driven by a first driving motor 144 provided on the second main body 100*b*.

The lower end of the link 146 is guided along and moveable a guide groove 130*b*1 formed in the second main body 100*b*. The upper end of the link 146 is rotatably coupled to the first main body 100*a*. Therefore, the first main body 100*b* and the second main body 100*b* may be displaced relative to each other by the link 146. The embodiment of FIGS. 7A and 7B is just one example illustrating displacement of the first main body 100*a* and the second main body 100*b* so as to change the relative positions of the two main bodies 100*a* and 100*b*. Other variations enabling displacement of the first main body 100*a* and the second main body 100*b* using a link and a driving gear may fall within in the scope of embodiments as broadly described herein.

Further, a second driving motor 141 may be connected to one end of one of the two heat exchangers 110*a* and 110*b* provided in the indoor unit 100. The second driving motor 141 changes the angle between the heat exchangers 110*a* and 110*b* based on whether or not the indoor unit 100 is operated. As shown in FIG. 7B, the angle between the heat exchangers 110*a* and 110*b* is changed when the indoor unit 120 is operated. During the process of generating the flow path inside the indoor unit 100, the angle between the heat exchangers 110*a* and 110*b* may be increased.

At least one driving gear 143 may be provided on a contact surface between the first main body 100*a* and the second main body 100*b* to provide driving force to guide a vertical or horizontal arrangement of the first main body 100*a* and the second main body 100*b*. The at least one driving gear 143 may include an independent driving device (for example, a driving motor) to provide driving force to vertically align the first main body 100*a* on the second main body 100*b*, or to horizontally position the first main body 100*a* beside the second main body 100*b*, and simultaneously prevent rapid position changes (for example, lowering of the first main body) so as to enable smooth movement of the first main body 100*a* and the second main body 100*b*.

In certain embodiments, order to raise or lower the first main body 100*a*, screw threads corresponding to driving gears 142 and 143 may be formed on the surface of the housing. In the embodiment of FIGS. 7A and 7B, screw threads may be formed on the lower surface of the first main body 100*a*. Therefore, the first and second driving gears 142 and 143 may be rotatable in a regular or reverse direction, thereby allowing the first main body 100*a* to be smoothly displaced in a horizontal direction.

As described above, a width of an indoor unit of an air conditioner in accordance with embodiments as broadly described herein may be changed according to whether or not the indoor unit or the fan in the indoor unit is operated.

In an air conditioner in accordance with embodiments as broadly described herein, the width thereof is variable based on whether or not an indoor unit of the air conditioner is operated, thus increasing space utility and improving interior effects.

An indoor unit of an air conditioner is provided.

In an indoor unit of an air conditioner, a width thereof is variable according to whether or not the indoor unit of the air conditioner is operated.

An indoor unit of an air conditioner as embodied and broadly described herein may include a housing, an heat exchanger disposed inside of the housing, an fan disposed in the housing, introducing air into the housing and then transporting the introduced air toward the heat exchanger, and discharging the heat-exchanged air to an room space and a driving device changing relative positions of the heat exchanger and the fan after electricity is supplied to the indoor unit.

An indoor unit of an air conditioner as embodied and broadly described herein may include an heat exchanger exchanging heat between a refrigerant and air, an fan disposed in front of or in the rear of the heat exchanger and a housing provided with an inlet through which the air is introduced into the housing and an outlet through which the air is discharged to the outside of the housing, wherein a flow path within the housing from the inlet of the housing to the outlet of the housing via the heat exchanger and the fan is changed after electricity is supplied to the indoor unit.

An indoor unit of an air conditioner as embodied and broadly described herein may include a housing, an heat exchanger disposed inside the housing, an fan disposed inside of the housing, and the unit has a first width when the unit is not operated and a second width when the unit is operated.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor unit of an air conditioner, the indoor unit comprising:

a heat exchanger that performs heat exchange between refrigerant and air;

a fan at one side of the heat exchanger;

a housing having an inlet through which air is introduced into the housing and an outlet through which air is discharged from the housing; and a flow path formed within the housing, from the inlet to the outlet via the heat exchanger, when the indoor unit is in a first mode, and wherein the flow path is eliminated when the indoor unit is in a second mode, wherein at least one of the heat exchanger or the fan is horizontally movable, and a distance between the heat exchanger and the fan is greater in the first mode than it is in the second mode.

2. The indoor unit of claim 1, wherein an end of the heat exchanger is rotatably coupled to a corresponding end of the fan.

3. The indoor unit of claim 2, wherein an angle formed between the heat exchanger and the fan in the first mode is less than the angle formed therebetween in the second mode.

4. The indoor unit of claim 3, wherein the heat exchanger and the fan are vertically stacked in the second mode such that the angle formed therebetween is about 180°.

5. The indoor unit of claim 1, wherein the housing comprises a first housing slidably coupled to a second housing, and wherein, in the first mode, the first and second housings are arranged such that a volume therebetween is maximized, and in the second mode, a volume therebetween minimized.

6. The indoor unit of claim 5, wherein at least one of the inlet or the outlet of the housing is opened by movement of one of the first or second housing.

7. The indoor unit of claim 1, wherein the heat exchanger is provided in the first housing and the fan is provided in the second housing, and wherein the first housing and the second housing are horizontally or vertically aligned, and relative positions of the heat exchanger and the fan are changed in response to movement of one of the first housing or the second housing.

8. The indoor unit of claim 7, wherein the heat exchanger comprises a first heat exchanger rotatably coupled to a second heat exchanger such that an angle between the first and second heat exchangers is variable, and wherein the angle between the first and second heat exchangers is changed in response to motion of at least one of the first housing or the second housing.

9. An indoor unit of an air conditioner, the indoor unit comprising:

an heat exchanger that performs heat exchange between refrigerant and air;

a fan positioned at one side of the heat exchanger; and a housing having an inlet through which air is introduced into the housing and an outlet through which air is discharged from the housing, wherein in a non-operational state of the indoor unit, a flow path within the housing, from the inlet to the outlet via the heat exchanger and the fan, is minimized, and wherein relative positions between the heat exchanger and the fan are changeable based on whether the indoor unit is in an operational state or the non-operational state so that a distance between the heat exchanger and the fan is smaller in the non-operational state than in the operational state.

10. The indoor unit of claim 9, wherein in the operational state of the indoor unit, the flow path is maximized within the housing, from the inlet to the outlet via the heat exchanger and the fan.

11. The indoor unit of claim 9, wherein the housing comprises a first housing slidably coupled to a second housing, and wherein, in the operational state, the first and second housings are arranged such that a volume therebetween is maximized, and in the non-operational state, the volume therebetween is minimized.

12. The indoor unit of claim 9, wherein the housing comprises a first housing slidably coupled to a second housing, and wherein, in the operational state, the first and second housings are arranged such that a distance therebetween is maximized, and in the non-operational state, the distance therebetween is maximized.

13. The indoor unit of claim 9, wherein the inlet and the outlet are closed in the non-operational state, when the flow path is minimized.

14. An air conditioner, comprising:

an indoor unit comprising:

a housing, comprising a first housing and a second housing movably coupled to each other;

a heat exchanger provided in the housing; and a fan provided in the housing, wherein in a first mode of the indoor unit, the first and second housings are in a first arrangement, and in a second mode of the indoor unit, the first and second housings are in a second arrangement, wherein the first and second arrangements are different.

15. The air conditioner of claim 14, wherein a position of at least one of the heat exchanger or the fan in the first mode of the indoor unit is different from its position in the second mode of the indoor unit.

16. The air conditioner of claim 14, wherein the indoor unit is operational in the first mode and the indoor unit is non-operational in the second mode.

17. The air conditioner of claim 16, wherein, in the first mode, the first and second housings are positioned at a maximum distance apart so as to form a flow path through the housing, with the heat exchanger and the fan positioned along the flow path.

18. The air conditioner of claim 17, wherein, in the second mode, the first housing is retracted into the second housing such that a volume of the housing in the second mode is less than a volume of the housing in the first mode.

19. The air conditioner of claim 14, further comprising a driving system operably coupled to one of the first or second housing so as to move the one of the first or second housing relative to the other of the first or second housing.

20. The air conditioner of claim 19, wherein the driving system comprises:

a plurality of hinges that rotatably couple the fan and the heat exchanger to the housing;

a motor that generates a rotating force; and a transmission device that transmits the rotating force of the motor to one of the plurality of hinges, wherein the transmission device comprises one of gearings, links or belts.

21. The air conditioner of claim 20, wherein the plurality of hinges comprises:

a first hinge that rotatably couples a first end of the heat exchanger to the housing;

a second hinge that rotatably couples a second end of the heat exchanger to a first end of the fan; and a third hinge that rotatably couples a second end of the fan to the transmission device so as to receive the rotating force of the motor.

22. The air conditioner of claim 19, wherein the drive system comprises a motor and gear that moves at least one of the first or second housing linearly with respect to the other of the first or second housing.

23. The air conditioner of claim 22, wherein the heat exchanger is provided in the first housing and the fan is provided in the second housing, and wherein the first housing engages a portion of the fan as the drive system moves at least one of the first or second housing so as to form a flow path through the housing, wherein the heat exchanger and the fan are positioned along the flow path.

24. The air conditioner of claim 19, wherein the heat exchanger is provided in the first housing and the fan is provided in the second housing, and wherein the drive system comprises:

a motor that generates a driving force;

at least one link coupled to the motor;

gearing that guides a rotation of the first housing about the second housing in response to movement of the at least one link.

25. The air conditioner of claim 14, further comprising an outdoor unit connected to the indoor unit connected by at least one refrigerant pipe.

* * * * *